United States Patent [19]

Garrett

[11] Patent Number: 4,542,797

[45] Date of Patent: Sep. 24, 1985

[54] ROLLER REAMER

[75] Inventor: William R. Garrett, Conroe, Tex.

[73] Assignee: Hughes Tool Company, Houston, Tex.

[21] Appl. No.: 246,210

[22] Filed: Mar. 23, 1981

Related U.S. Application Data

[63] Continuation-in-part of Ser. No. 174,515, Aug. 1, 1980, abandoned.

[51] Int. Cl.[4] ..... E21B 10/30; E21B 10/22

[52] U.S. Cl. ..... 175/228; 175/347

[58] Field of Search ..... 175/346, 347, 344, 345, 175/228

[56] References Cited

U.S. PATENT DOCUMENTS

| | | | |
|---|---|---|---|
| 2,189,040 | 2/1940 | Jones | 175/346 |
| 2,199,693 | 5/1940 | Catland | 175/346 |
| 2,695,771 | 11/1954 | Salvatori | 175/346 |
| 3,897,837 | 8/1975 | Peterson | 175/228 |
| 4,182,245 | 1/1980 | Garrett | 175/228 |
| 4,226,291 | 10/1980 | Spelts | 175/325 |
| 4,254,839 | 3/1981 | Schpok et al. | 175/345 |
| 4,262,760 | 4/1981 | Allison | 175/347 |

*Primary Examiner*—James A. Leppink
*Assistant Examiner*—Bruce M. Kisliuk
*Attorney, Agent, or Firm*—Vaden, Eickenroht, Thompson & Jamison

[57] ABSTRACT

A roller-reamer structure wherein for each roller shaft, the shaft is tightly, but releasably secured, both radial and thrust bearings being provided for relatively moving roller and shaft surfaces. The shaft is held in the various embodiments within accommodating slots by an interference fit between the shaft and the accommodating slot, by a partially slotted longitudinal opening that allows squeezing of a block about the shaft end, by a tapered shaft end being wedgedly held or by a slotted block opening and tapered wedging block member for tightly securing the shaft. Some combinations include a sealed and protected self-lubricating reservoir.

50 Claims, 41 Drawing Figures

FIG. 9
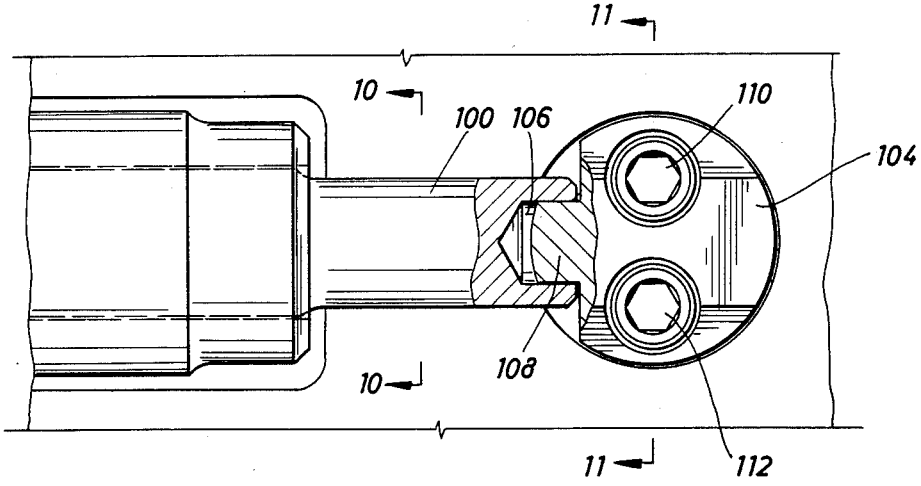
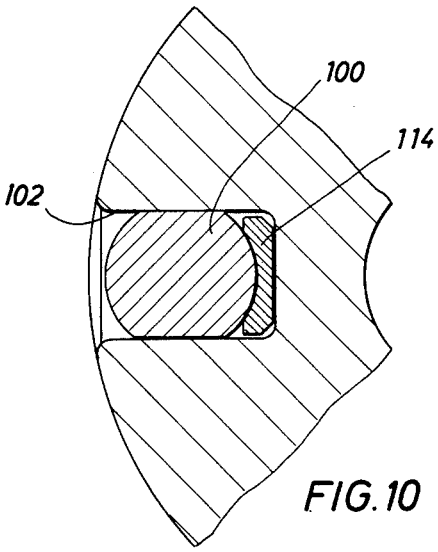
FIG. 10
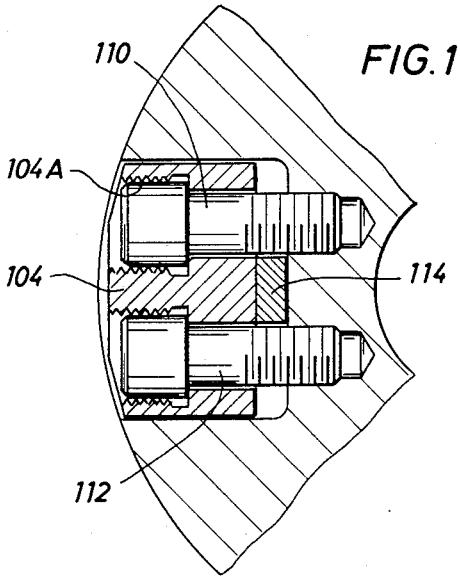
FIG. 11
FIG. 12
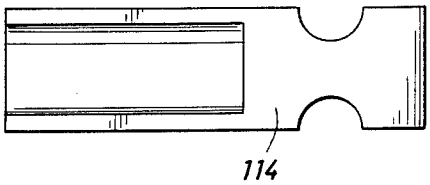
FIG. 14
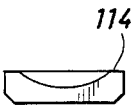
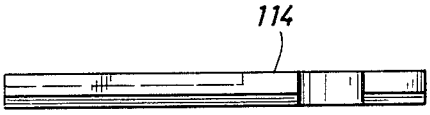
FIG. 13

FIG. 18
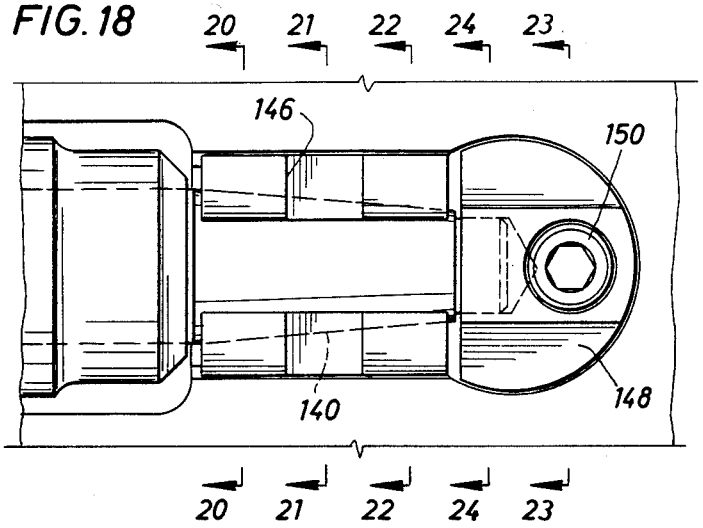
FIG. 20
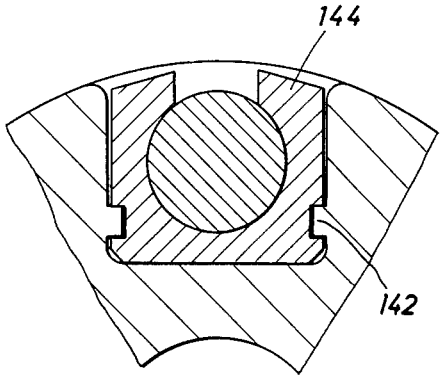
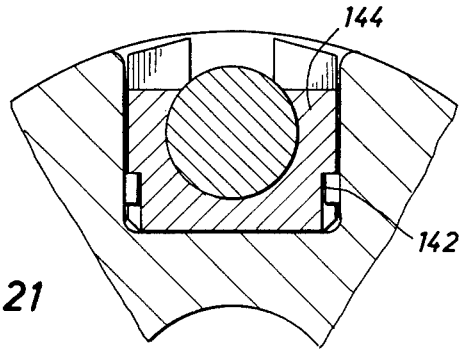
FIG. 21
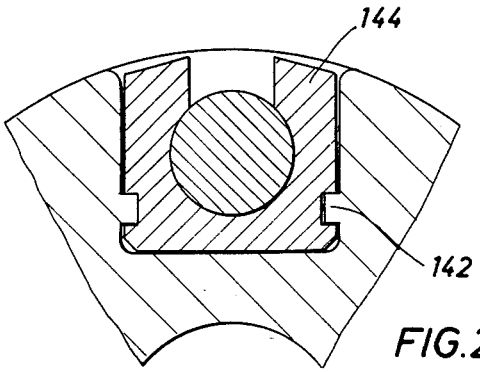
FIG. 22
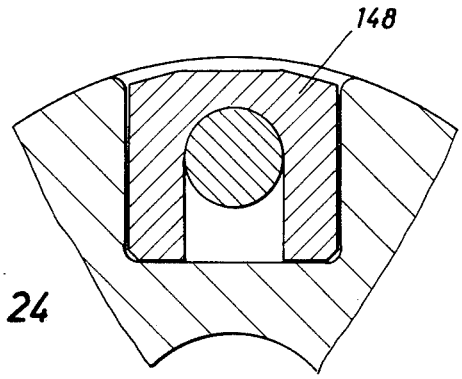
FIG. 24
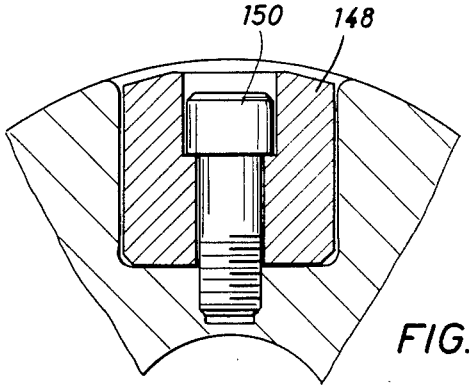
FIG. 23
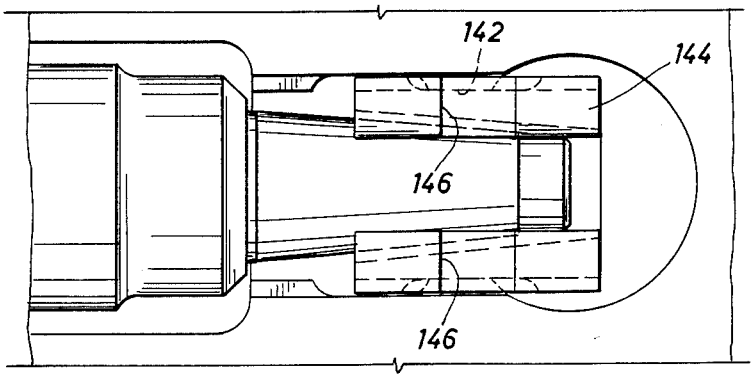
FIG. 19

FIG. 25
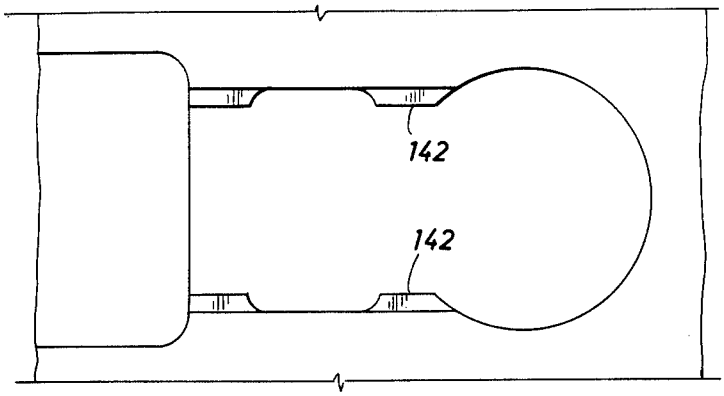
FIG. 26
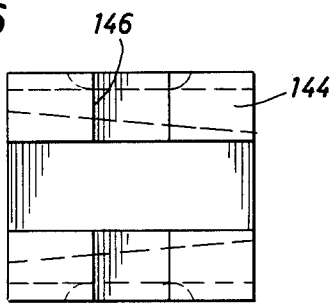
FIG. 27
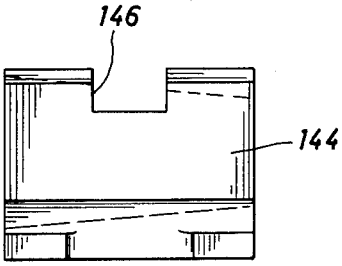
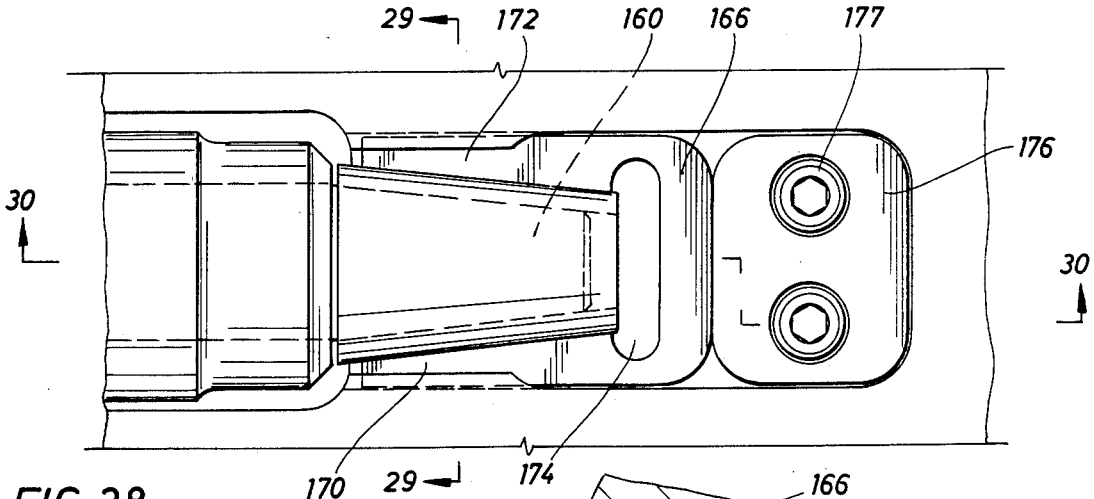
FIG. 28
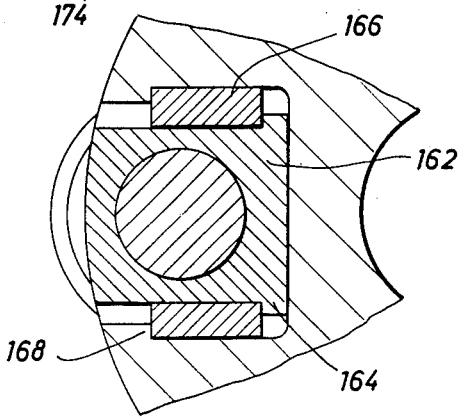
FIG. 29

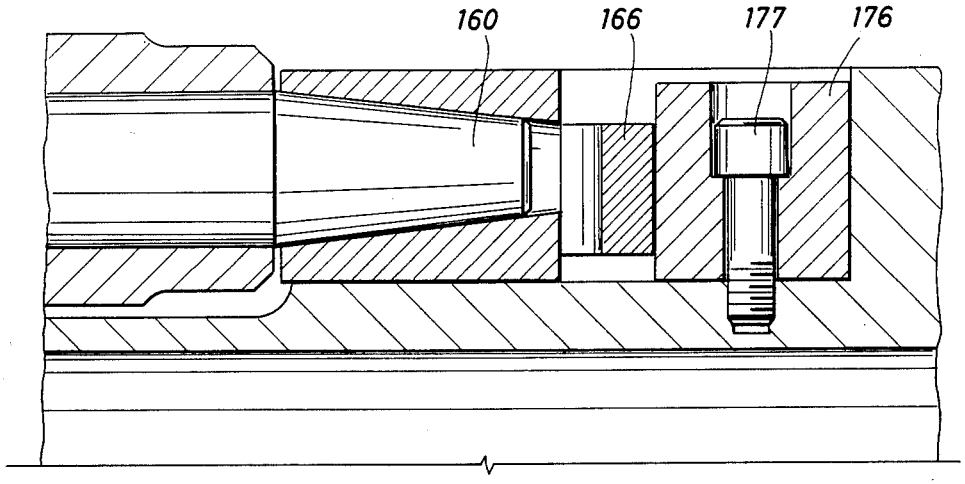
FIG. 30
FIG. 31
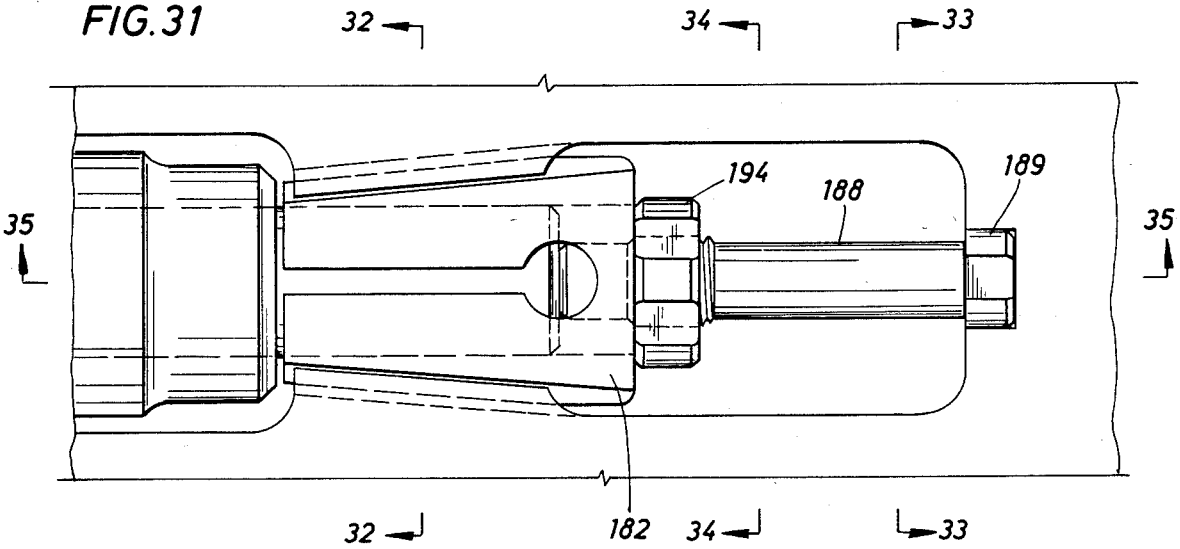
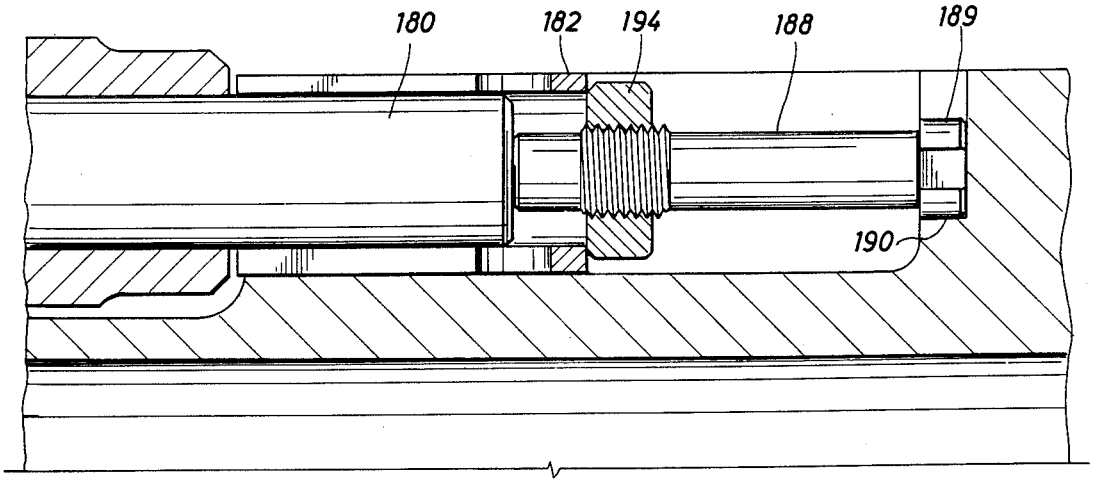
FIG. 35

ROLLER REAMER

This application is a continuation-in-part of copending application Ser. No. 174,515 entitled "Roller-Reamer", filed Aug. 1, 1980 now abandoned.

BACKGROUND OF THE INVENTION

1. Field of the Invention

This invention pertains to bore hole drilling apparatus and more specifically to that part of such apparatus known in the industry as a roller-reamer.

2. Description of the Prior Art

Roller-reamers have been employed in earth boring operations for the petroleum industry to provide two main functions. Depending upon the particular structure, these functions may be provided in a combination tool or the functions can be provided separately.

The first function that is provided by a roller-reamer is to cut formations to enlarge the hole to the desirable size, which may be the original size of the bit in the case where the bit wears to be under-gauged. However, even for new bits, roller-reamers are employed to cut formations because the bit does not always drill a true bore hole and because of slight lateral shifting which is inherent in the drilling operation, which shifting leaves ledges and other distortions.

The second function of a roller-reamer is to keep the drill stem in the center of the hole at the specific position of placement of the roller-reamer. In providing such a function, a reamer is often referred to as a "stabilizer". Maintaining the drill stem centered has many beneficial effects, its primary one being minimizing unintentional hole-angle directional drilling.

Generally speaking, a roller-reamer will always include the following parts: (1) Threaded connections at each end of the body for connection into the drill string at either end of the reamer. (2) Rollers and shafts (sometimes referred to as "cutters and pins") with axial and radial bearings. It should be noted that virtually all reamers have shafts extending through the rollers with the radial bearings being located between the two. In some instances, a trunnion design with a shaft integral with the roller and extending on each end of the roller is provided. In such case, the shafts rotate with the roller in sockets. (3) Fluid circulation passage through a hole in the center of the body.

Popular hole sizes for well bores range from 5" to 26" in diameter. Size of circulation passage through the center of the body of the reamer typically range from $1\frac{1}{2}$" to $3\frac{1}{4}$" in diameter. The body size on the necks beyond the area where the rollers are mounted typically range from $4\frac{1}{8}$" to 11" in diameter. This latter size will normally be the same size as the drill collar. Body links normally range from 4' to 8'.

Most roller-reamers have three rollers equally spaced in a single transverse section. Such roller-reamers are referred to as "3-point reamers". When two sets of three rollers spaced apart longitudinally are used, the roller-reamer is called a "6-point reamer". However, large diameter roller-reamers may have more than three rollers in one transverse section.

For purposes of discussion herein, a "roller-reamer unit" will refer to a single shaft, roller and related parts and "roller-reamer" will refer to the entire assembly of three or more roller-reamer units.

Bearing surfaces are normally case hardened, usually by the process of carborizing, quenching in oil from austinite at about 1500° F. When the roller or cutter is to be used for difficult reaming operations, the outer surface or cutting structure will have pressed fitted therein sintered tungsten carbide compacts for the cutting structure. However, when the roller is to be used mostly as a stabilizer, and only light reaming operations are to be encountered the outer surface may only be carborized and hard-faced with tungsten carbide particles.

In all events, most of the roller-reamer component parts are designed and manufactured to be replaceable so that as wear occurs, the worn parts are discarded and new parts are installed on the tool. It is desirable that the construction be such that the most expensive parts do not have to be replaced any more often than necessary. Also, it is desirable that the construction be such so as to minimize excessive wear from occurring in the first place under the environmental conditions of use. It should be remembered that a roller-reamer is subjected to extremely abusive conditions during its use by the very nature of such use. For example, this abuse results from twisting of the drill string and resistance thereto, longitudinal surges in handling the drill string and from the pressures of the formation and the fluids introduced for drilling purposes, from the variations in the lithological conditions encountered while drilling and in handling of the string for maintenance, repairs and non-drilling operations (e.g., removal for logging purposes, fishing purposes and the like).

It has been known that a condition imposed on the drill string known as "fretting" is one of the worse conditions that causes wear of the roller-reamer parts. Fretting is the small vibration act that constantly occurs in operation because of the many conditions imposed on the drill string during drilling. Fretting occurs in an up and down, back and forth motion and in a rotational motion all at once. To ensure minimum wear between adjoining parts, it is desirable to fixedly secure together as many parts as possible and to minimize the number of parts that have to move with respect to each other in the first place. In so doing, the places where fretting has an opportunity to occur is kept to a minimum. But, for places where it is not possible to fix one part to another, then it is desirable to have a bearing surface between such parts. Since some parts of a roller-reamer are rotational with respect to one another by their very nature, such parts cannot be fixed to each other. Other parts cannot be rigidly joined because they have to accept impacts beyond the flexure capability of the metal alone. Absence of such capability would cause premature damaging fatigue and fracture. Yet other parts cannot be permanently fixed or joined or eliminated in a simplified structure because they have to be non-destructively removable to facilitate replacement of worn parts.

It cannot be over-emphasized that roller-reamer assemblies are notoriously short-lived because of the extremely hard wear to which they are subjected, which wear is exerted on the assembly in all possible conceivable patterns and directions. As is explained hereinafter the embodiments of the present invention reduce the number of component parts compared with the prior art while maintaining tight fitting of those parts that do not have to have relative movement, providing bearing surfaces for those that do. In addition, by making some parts reversible, the effective life of many that do wear out is extended greatly. Furthermore, the embodiments presented herein also do not subject parts, other than the roller part itself, to gauge wear. That is, all other components are well within the outer limits of the outside diameter of the roller.

Perhaps the largest contribution of the present invention, therefore, is the virtual elimination of two types of wear occurring in prior art structures. Wear occurs during use in such structures (1) at the outside of the roller, (2) at the inside surface of the roller, (3) at the outside periphery of the shaft underneath the roller, (4) at the outside surface of the shaft inside the blocks, and (5) at the inside surface of the blocks. The latter two wear conditions are a result of fretting under dynamic loads. Fretting is almost totally eliminated in the embodiments of the present invention described hereinafter, and, hence, so are the types of wear that would normally accompany fretting.

The most relevant designs known prior to the present invention are shown and described in U.S. Pat. No. 4,182,425. These designs include a roller-reamer unit having a replaceable block structure for holding the shaft around which the cylindrical roller rotates (FIG. 1); a similar structure having a thrust bearing between the roller and the block (FIG. 1A); a similar structure wherein the shaft is welded to the block, the shaft also being flanged for accepting an axial thrust impact (FIG. 1B); and a similar structure wherein the upper block is welded to the shaft, there being a thrust flange or bearing and there being reservoirs for lubricating between sealed, relatively rotational components of the structure (FIGS. 9, 9A, 9B, 9C and 9X). The other structures of '425 related to roller-reamers having air bearings and are not relevant to the present invention.

The blocks used in the embodiments disclosed in '425 are expendable components which wear with use because of fretting and otherwise. Although such blocks facilitate replacement, having to throw away previously used blocks contributes substantially to the cost of using a roller-reamer. In the roller-reamers employing a sealed bearing construction, the top block is expended each time a roller and shaft is worn out because the block is welded to the shaft.

Also, in the sealed bearing roller-to-shaft construction of the '425 patent, the lower block must protrude beyond the body diameter in order to protect the lower seal between the roller and shaft in a heavy reaming operation. Especially in such an embodiment but in the case of all of the lower blocks employed in the embodiments shown in the '425 patent, the outer surface of such blocks are subjected to wear during the reaming operation. Such wear is a result of fretting at the shaft contact and at the points of wear engagement of the outer surface with the borehole.

Experience has shown that with all of the nonsealed constructions of patent '425, both top and bottom blocks must be replaced by the time two or three sets of rollers and their shafts are worn out as a result of the types of wear mentioned above and because of wear resulting from the thrust of the reamer in action.

The prior art also reveals a system for tightening the shaft of a roller-reamer unit into the body in such a manner to presumably tightly hold it, but this technique critically fails to cause uniform securing and therefore invites non-uniform wear and fretting after short periods of use. In this system, the end of the shaft is split. A block having a transverse tapered pin is forced over the shaft end, the pin acting within the slot to force the end of the shaft apart against the inside surface of the block. The block is then welded in place. The tapered pin successfully tightens the end of the shaft against the block at the two points normal to the axis of the pin. But, the pin does not successfully tighten the shaft end at locations remote from these two points, thereby inviting wobble and uneven wear. Further, welding the block means it must be destroyed each time the shaft is replaced.

Therefore, it is a feature of the present invention to provide an improved roller-reamer apparatus wherein each replaceable roller-reamer unit employs either no blocks or few block parts, and wherein the unit is otherwise completely tightly fitted within the body of the roller-reamer and the moving parts are protected with radial and thrust bearings.

It is another feature of the present invention to provide an improved roller-reamer unit wherein the shaft is replaceable but tightly fitting with the body, thereby eliminating wear attendant to fretting.

It is still another feature of the present invention to provide an improved roller-reamer unit having releasable shaft blocks, the shaft tightly fitting with the blocks and the blocks within the body, thereby achieving wear-elimination of the blocks because of fretting.

It is yet another feature of the present invention to provide an improved roller-reamer unit having a block that does not radially protrude beyond the limits of the roller portion.

It is still another feature of the present invention to provide an improved roller-reamer unit with an internal lubrication reservoir, the lubrication being provided between the shaft and the reamer, the lubricated portion being sealed substantially at both the upper and lower ends of the roller.

It is yet another feature of the present invention to provide an improved roller-reamer unit having roller bore hole contacts below the lower lubricating seal to provide protection therefor.

It is still another feature of the present invention to provide an improved roller-reamer unit shaft that is 180 radial degrees reversible for extending the effective useful life of such shaft.

SUMMARY OF THE INVENTION

The embodiments of the roller-reamer inventions herein disclosed each include means for tightly securing the shaft of a roller-reamer unit to the body of the roller-reamer. In one embodiment a reduced end portion of the shaft is forced by interference fit into a shaft slot and secured by a cap screw to assure firmly seating the shaft to the body within the confines of the shaft slot. Another embodiment secures the end using a safety plug held in place by cap screws, which, in turn, secures against the shaft end inadvertently coming loose. Other embodiments employ blocks that are secured rigidly in place by screws or wedge fitting and which, in turn, tightly hold the shaft end by a flexed open slot or a tapered wedging action or both provided via a block. The block is protected from being dislodged by a plug, a nut-and-bolt arrangement, an auxiliary U-wedge fitting around the block, or the like in various exemplary embodiments. In each case, the ends are secured in such a manner that no structure utilized in tightly connecting the shaft to the body extends beyond the limits of the cutter or employs welding or other non-releasable connecting means.

One embodiment of a shaft and roller combination employs an internal lubricating reservoir pressurized to emit lubricant between the shaft and roller, the lubricated area being sealed and the lower seal being protected by a reaming element on the surface of the roller rather than by a block protruding surface therebelow, as with the prior art.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the appended drawings illustrate only preferred embodiments of the invention and are therefore not to be considered limiting of its scope, for the invention may admit to other equally effective embodiments.

In the Drawings:

FIG. 9 is a partial longitudinal cross-sectional view of an alternate embodiment of a roller-reamer unit employed in a roller-reamer in accordance with the present invention.

FIG. 10 is a partial transverse cross-sectional view taken at line 10—10 of FIG. 9.

FIG. 11 is a partial transverse cross-sectional view taken at line 11—11 of FIG. 9.

FIGS. 12, 13 and 14 are the top, side and end views, respectively, of a shaft seat employed in the embodiment of the invention shown in FIG. 9.

FIG. 18 is a partial longitudinal cross-sectional view of yet another alternative embodiment of a roller-reamer unit employed in a roller-reamer in accordance with the present invention.

FIG. 19 is a partial longitudinal cross-sectional view of the embodiment shown in FIG. 18 showing the block portion partly assembled.

FIGS. 20, 21, 22, 23 and 24 are transverse cross-sectional views taken respectively at lines 20—20, 21—21, 22—22, 23—23 and 24—24.

FIG. 25 is a partial longitudinal cross-sectional view of the block slot employed in the embodiment of the invention shown in FIG. 18.

FIG. 26 is a partial longitudinal cross-sectional view of the block employed in the embodiment of the invention shown in FIG. 18.

FIG. 27 is a side view of the block shown in FIG. 26.

FIG. 28 is a partial longitudinal cross-sectional view of still another alternative embodiment of a roller-reamer unit employed in a roller-reamer in accordance with the present invention.

FIG. 29 is a transverse cross-sectional view taken at line 29—29 of FIG. 28.

FIG. 30 is a longitudinal cross-sectional view taken at line 30—30 of FIG. 28.

FIG. 31 is a partial longitudinal cross-sectional view of yet another alternative embodiment of a roller-reamer unit employed in a roller-reamer in accordance with the present invention.

FIGS. 32, 33, 34 and 35 are cross-sectional views taken respectively at lines 32—32, 33—33, 34—34 and 35—35 of FIG. 31.

DESCRIPTION OF THE PREFERRED EMBODIMENTS

Figure 1:
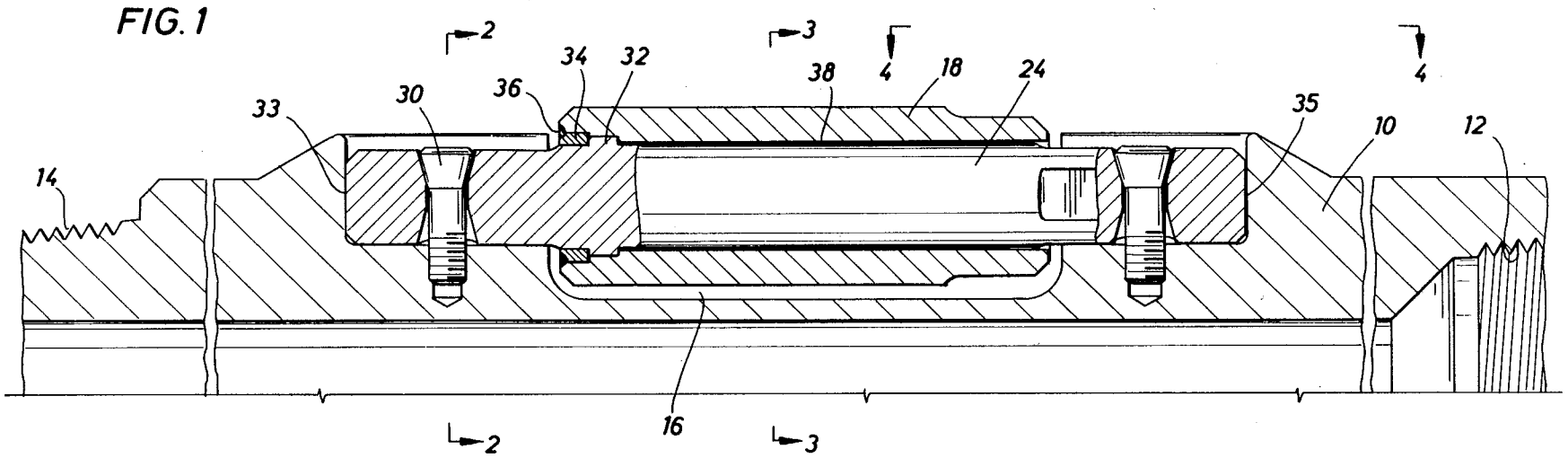
FIG. 1 is a longitudinal cross-sectional view of a roller-reamer unit employed in a roller-reamer in accordance with the present invention.

Now referring to the drawings, and first to FIG. 1, a roller-reamer unit in accordance with the present embodiment is shown in longitudinal cross-section. It is usual that such units are deployed about body 10 of the roller-reamer so that there are three such units in each roller-reamer or so that there are multiple groups of three such units.

At either end of body 10, the roller-reamer is threaded at threads 12 and 14 for suitable connection to adjoining members cooperatively threaded therewith in the drill string. The body of the roller-reamer includes a fluid circulation hole therethrough and is normally located not too far above the drill bit. It should be noted that threads 12 are located within the box section and threads 14 are located within the pin section. For purposes of discussion, the pin section is considered to be at the top end of the roller-reamer assembly and the box section is considered to be at the lower end.

The body includes an outwardly opening elongated slot pocket 16 for receiving the elongated roller 18 therein. The roller is somewhat less elongated than the pocket, as well as being dimensionally less in diameter, so that fluid in the bore hole which is present for drilling purposed circulates around the periphery of the roller as well as between each of adjacent rollers in the annulus formed by the hole bore and reamer body outer diameter.

It may be further noted that the openings around the roller are slightly rounded at their outer periphery at corners 20 and 22 to minimize the possibility of improvident lodging of foreign matter.

Roller 18 is generally cylindrical in shape and is mounted on a shaft 24, the shaft and roller being concentrically positioned on a common axis. The shaft extends beyond the limits of the roller for mounting purposes within an accommodating shaft end slot 26. Slots 16 and 26 are contiguous; however, slot 26 is reduced in size to accommodate and conform to the shaft end in the manner hereafter described.

Figure 2:
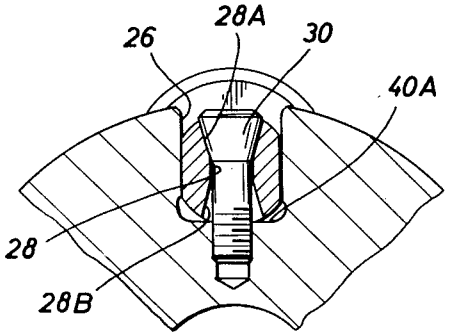
FIG. 2 is a transverse cross-sectional view taken at line 2—2 of FIG. 1.

As may be best shown in FIG. 2, the surfaces of the shaft and the adjoining contiguous surfaces of slot 26 are flat so as to keep the shaft from turning and for providing an increased pressure area for better containment of shaft to body. It should also be noted that the shaft ends are each bored with an opening 28, which is generally on a radial axis. Bore 28 gradually outwardly flares to the outside at flare 28A and to the inside at flare 28B and is sized for accommodating as a seat a safety cap screw. The body is bored and tapped in alignment with bore 28 for receiving cap screw 30. Bore 28 is flared out in the opposite directions in a symmetrical manner so that when the shaft is rotated 180°, cap screw 30 is equally accommodated.

In assembly of the shaft within the shaft slots, the shaft is pressed into place in the shaft slots at either end so as to form abutments 33 and 35 for high-thrust loads. There is an interference fit not only at both ends, but also along either side of shaft slot 26. That is, the flat surfaces on the shaft are slightly further apart than the width of slot 26 in the body and the parts are held in position relative to one another by slight metallic elastic deformation.

The cap screw is tightened in place in conventional manner; however, it should be noted that its head in its tightened position is still within the confines of the shaft slot and does not radially extend outwardly pass the surface of the roller into the bore. Of course, the shaft end is even further within the shaft slot.

Returning to FIG. 1, note that shaft 24 includes an enlargement or flange 32 for carrying thrust loading with respect to a thrust bearing ring 34 above the thrust flange. That is, the radial surfaces of the flange contact and carry some of the longitudinal load when there is a dynamic thrust force encountered during operation. Ring 34 is secured at the upper end of roller 18 by welds 36, ring 34 being located between the roller and shaft. Thrust bearing rings around the shaft between each end of the roller and the body could be equally effective. Radial bearing 38 is provided between the internal surface of the roller and the outside surface of the shaft within the roller.

Figure 4:
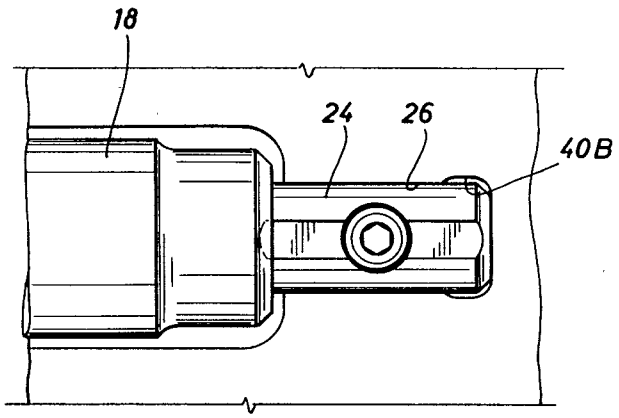
FIG. 4 is a top fragmentary view of FIG. 1 showing the details of the shaft end.
Figure 3:
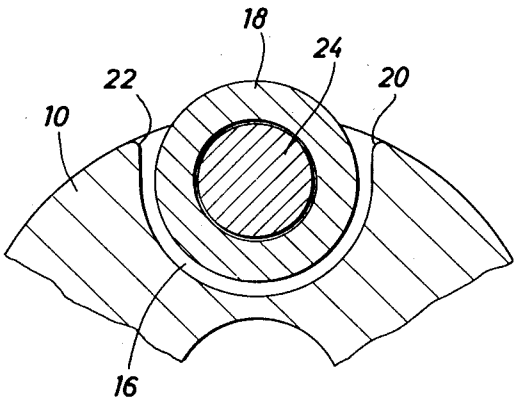
FIG. 3 is a transverse cross-sectional view taken at line 3—3 of FIG. 1.

As described above, it has been pointed out that there are two places where thrust loads are carried, at the roller thrust bearing and at the body-to-shaft abutments. Now referring to FIG. 4, it may be observed that the slot in which the shaft is located is slightly enlarged at the tip of the shaft. Very heavy thrusts will cause both the shaft and the body to slightly elastically deform. If the shaft was held in a tight manner at every bit of surface area, the tip of the shaft might well receive such squeezing or pressure that it would cause metal failure at that point. Slot enlargement 40A and 40B, which is somewhat inherent in the manufacture of the slot, provides relief from the creation of such destructive pressure.

In removing the shaft for replacement purposes, the cap screws are first removed and then an expandable puller tool is inserted through the cap screw bore 28 into the tapered back portion 28A of bore 28, allowing the tool to expand for pulling purposes. If the shaft is still unworn on one side, then it is rotationally reversed 180° and reinserted, as before.

Figure 5:
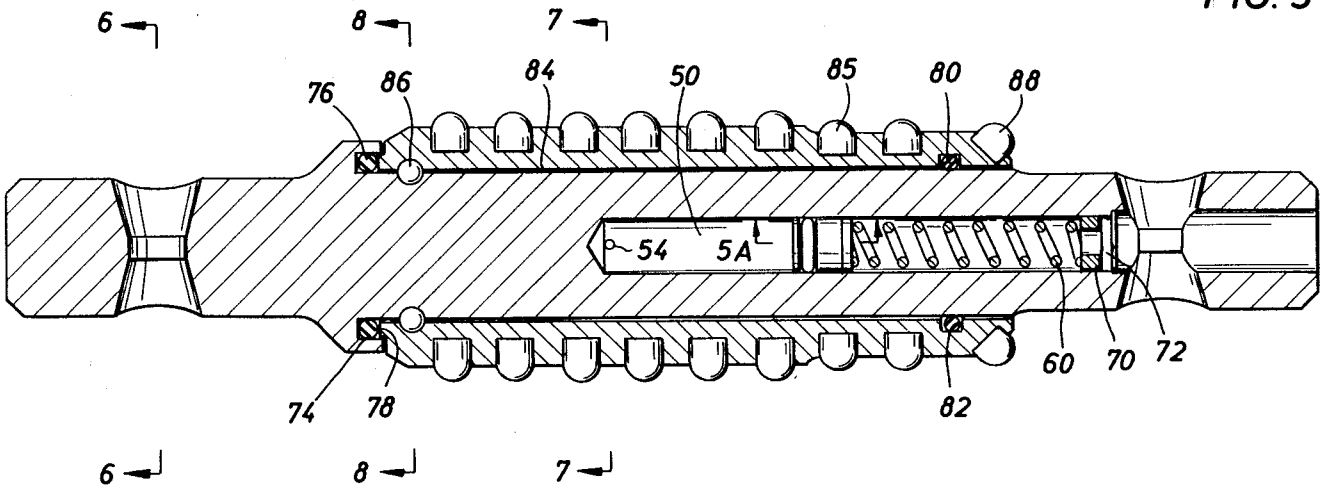
FIG. 5 is a longitudinal cross-sectional view of a self-lubricating roller-reamer unit subassembly for a roller-reamer in accordance with the present invention, FIG. 5A a part of the reservoir assembly.
Figure 5A:
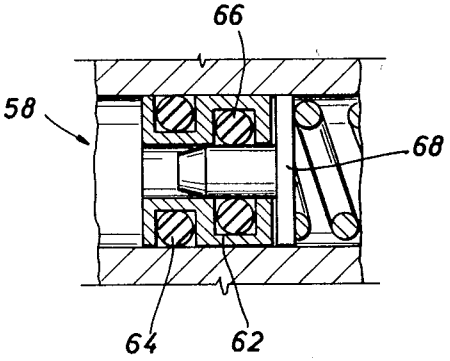

Now referring to FIG. 5, an embodiment of a roller-reamer unit is shown which includes a self-contained lubricating means for lubricating the surfaces between the shaft and the roller.

At the upper end of the entire assembly, the shaft is formed in such a manner so as to create skirted slots 74 for receiving O-rings 76. An upward projection 78 from the roller presses against the O-ring, thereby establishing an effective seal at the upper end of the roller. At the lower end of the roller, O-rings 80 acting within an accommodating slot 82 forms an effective seal with respect to the shaft and the roller. Radial bearings 84 and thrust ball bearings 86 are provided between the shaft and the roller within the area between seals 76 and 80. It should be noted that the cutting surface of the roller is provided by carbide compacts 85 pressed into place. One such cutter row 88 is located in a lower depending skirt portion on the roller which depends below seals 80. Such a location for this cutter row provides protection against foreign matter working its way between the shaft and the roller at this location. Note that the shaft does not have to be enlarged and blocks do not have to be provided for the shaft to protect such seal as with many prior art structures.

Figure 8:
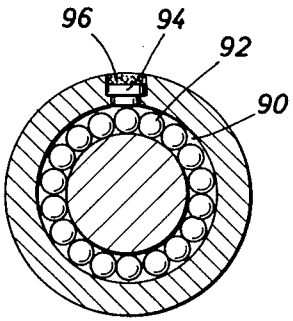
FIG. 8 is a partial transverse cross-sectional view taken at line 8—8 of FIG. 5.
Figure 7:
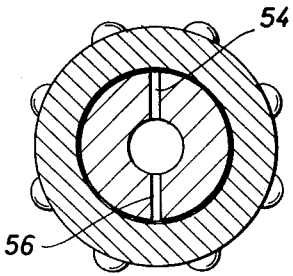
FIG. 7 is a transverse cross-sectional view taken at line 7—7 of FIG. 5.
Figure 6:
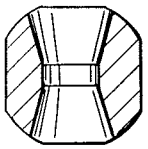
FIG. 6 is a transverse cross-sectional view taken at line 6—6 of FIG. 5.

The thrust bearing can readily be provided as shown in FIG. 8. A trace 90 is provided in both the shaft and the internal roller surface, as shown. A radial hole is provided through the roller through which balls 92 can be inserted for filling the trace. After the trace is full, plug 94 is used to fill the hole, on top of which weld 96 is provided to seal off the plug and to insure that no foreign matter enters the trace through the previous radial opening through the roller.

The entire roller-reamer unit which has been described in connection with FIGS. 5–8 is mounted within the roller-reamer in the same manner as the unit or assembly illustrated in FIGS. 1–4.

Reservoir 50 is provided along the axis of the shaft internal thereto and extending from side opening into cap screw bore 52. Lubrication or grease ports 54 and 56 are provided at the internal end of the reservoir and extend to the outside surface of the shaft underneath the roller at about the mid-point of the roller.

Pressure is put on the lubricant within the reservoir by way of a spring and piston arrangement comprising at one end an O-ring seal assembly 58 explained more fully hereafter but which is pressed toward the grease ports via helical coil spring 60.

The reservoir operation can be more fully understood in relation to its loading.

The lubricating reservoir is filled in the following manner. First, the shaft, roller-reamer, seals and ball thrust bearings are assembled. Then the reservoir and the bearings are all subjected to a vacuum while grease is forced into the bearings and reservoir under atmospheric pressure.

S-shaped seal holder 62 with seals 64 and 66 held therein is then longitudinally forced through the reservoir into its proper position. Excess grease is allowed to flow through its axially central opening as it is pushed forward. Seal 64, held by seal holder 62, operates in contact with the walls of the reservoir. Inward acting seals 66 then seals off the reservoir and bearings with the insertion of plug 68 in the center opening.

Next, helical coil spring 60 is inserted to cause a slight pressure on the grease in the reservoir. Then ring 70 is pressed into bore 72 with a tight fit to its proper position to compress spring 60 for the correct pressure in the reservoir.

It is important that the pressure on the inside of the lubricant reservoir be only slightly higher than the outside. It should be sufficient to urge the clean lubricant under the seal and prevent intrusion of the drilling fluid. It should not be so high that excess pressure and friction would cause short seal life.

In operation, as lubricant escapes during use, the volume compensator comprising the piston and spring just described will squeeze out additional lubricant or grease through ports or passages 54 and 56 to the bearings.

Of course, the bladder structure reservoir shown in FIGS. 9 and 9A of U.S. Pat. No. 4,182,425 could be employed in place of the reservoir structure just described, if desired.

Now turning to FIG. 9, an embodiment of the invention is shown wherein the end of the shaft 100 is shown secured within accommodating shaft slot 102 by interference fit as before. But instead of the shaft being secured to the body through the shaft slot by way of a cap screw, a safety plug 104 is employed. The end of shaft 100 is longitudinally bored with an enlarged hole 106 along its axis for receipt of an inward projection 108 form plug 104. Plug 104 is held in place to the body by way of cap screws 110 and 112, the body being bored and tapped in alignment with the accommodating bore holes in plug 104.

Located behind the end of shaft 100 is a shaft seat 114, as best shown in FIGS. 12–14. The shaft seat is contoured to accommodate the curvilinear surface of the end of shaft 100 and includes notches for partly surrounding the cap screws when they are in place and to hold the seat in proper location. The shaft seat allows a certain amount of sizing of the hole to be reamed by the roller-reamer. A very thin shaft seat would mean that the roller-reamer would cut a relatively small diameter hole and a large thickness shaft seat would mean that the diameter of the reamed bore would be somewhat larger.

Countersunk holes for the heads of cap screws 110 are threaded with threads 104A to receive a puller tool for removal of shaft, roller and plug.

Figure 15:
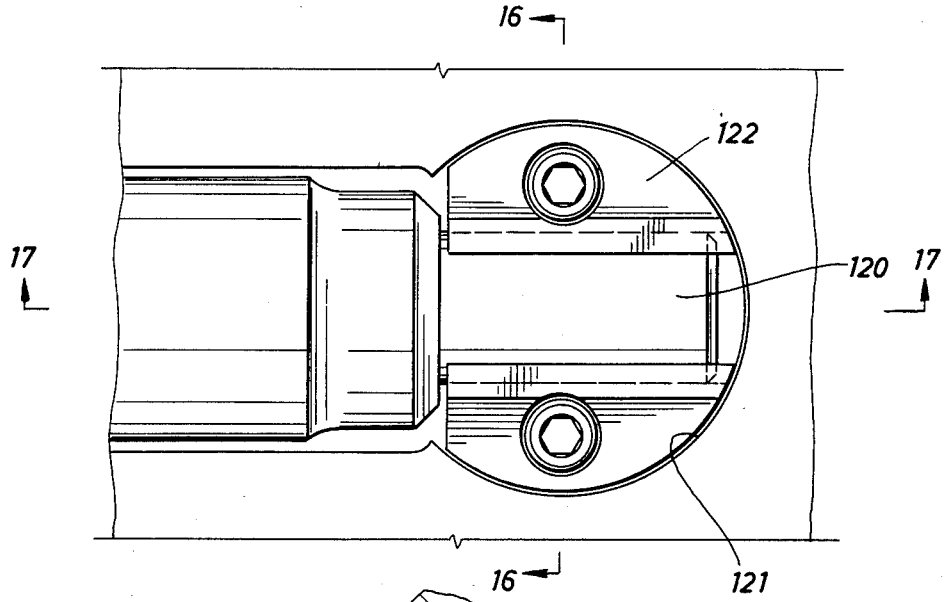
FIG. 15 is a partial longitudinal cross-sectional view of another alternate embodiment of a roller-reamer unit employed in a roller-reamer in accordance with the present invention.
Figure 16:
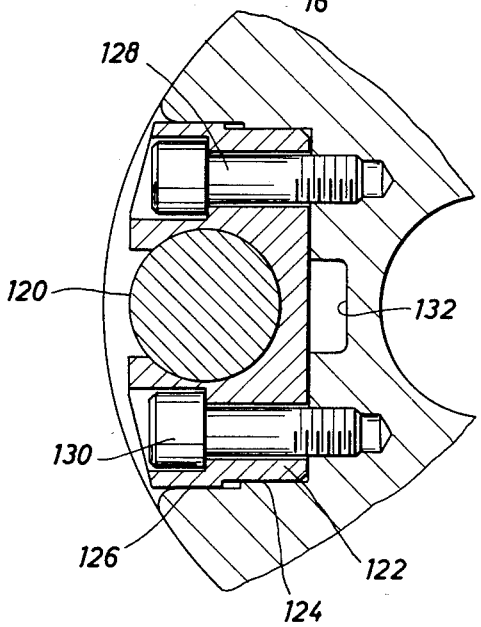
FIG. 16 is a partial transverse cross-sectional view of the embodiment shown in FIG. 15 taken at line 16—16.

Now referring to FIG. 15, a connector arrangement for securing shaft 120 in position is shown. In this embodiment, pocket 121 which is contiguous with the main pocket surrounding the roller is suitable for accepting block 122. Block 122 is stepped on its sides at flats 124 and 126 for being pressed within its slots by an interference fit. The longitudinal opening through the block for accommodating the end of the shaft is opened on the external side for permitting flexure of the block about the shaft end.

In mounting the shaft, the block is put in position about the end, the shaft and block are inserted into the accommodating block slot with an interference fit obtaining at cylindrical segment 124 and 126. At this time, the shaft can be tight or a little loose within block 122. Insertion of block 122 into opening 121 causes the open slot through the block to be squeezed about the shaft end. Cap screws 128 and 130 are then tightened into position through bore holes in block 122 into aligned bored and tapped holes in the body.

Figure 17:
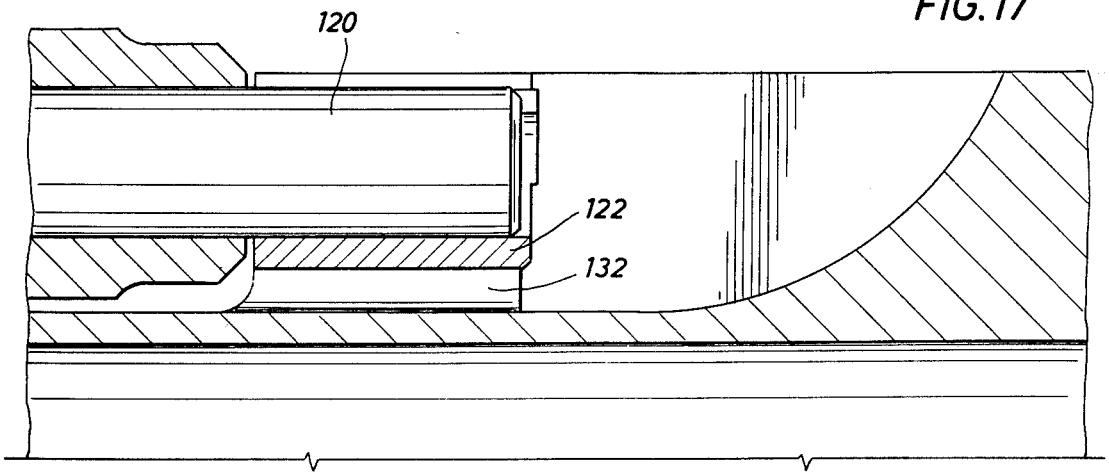
FIG. 17 is a partial longitudinal cross-sectional view taken at line 17—17 of FIG. 15.

There is a elongate removal slot 132 located behind block 120 which extends past the longitudinal end of the shaft, as best seen in FIG. 17. A removal tool may be placed in slot 132 for removal of block 120 in a manner similar to that shown in FIG. 9C of U.S. Pat. No. 4,182,425.

Now referring to FIG. 18, a roller-reamer unit attachment is shown, wherein the end of the shaft is tapered at end 140. The block pocket through which the shaft end extends includes block hold down tangs 142 deeply within the slot and running longitudinally therewith. As is shown in FIGS. 20–22, block 144, which fits over the end of the shaft, is grooved for mating with tangs 142. The block includes a longitudinal opening hole which is tapered to receive the shaft and which opening is open on one side to permit squeezing flexure of the block about the shaft for tight fitting. As may be seen by FIG. 19, the block slot is contiguous with a safety plug slot therebelow for permitting insertion of the block after the roller end is in approximate position. The block is then pressed over the shaft end with the accommodating grooves of block 144 in position over tangs 142, as shown. There are crosswise impact surfaces 146 on the outside surfaces of block 144 to permit a tool to be used for driving the block onto the end of the shaft. These surfaces are approximately normal to the axis of the shaft. As the block is moved toward the center of the shaft on its end, the flexure of the opening in the block tightly squeezes the end of the shaft. The taper causes the block to become tight in the body slot.

Once the block is in position, as shown in FIG. 18, a safety plug having an opening slotted to its inside, is positioned over the shaft end and then the plug is secured, as with the other embodiments by a cap screw 150, through a bore in the safety plug and into an aligned bore and tapped screw hole in the body aligned with the cap screw bore in the block.

Now turning to FIG. 28, a tapered end 160 of the shaft is shown secured by a block 162 having outwardly turned lips 164 deeply within the accommodating block slot and a U-shaped wedge member 166 about the block. The slot has inturned lips 168 near the opening of the slot and aligned opposite lip 164, as best shown in FIG. 29. The U-shaped wedge member includes two prongs 170 and 172 for positioning about block 162 and wedging forward by a tool placed within the block slot and axially forcing the wedge member, and hence the block, toward the main body of the shaft. Prongs 170 and 172 are each wedge-shaped so that as the wedge-shaped member is forced forward, the block is tightened in position. The base of the U-shaped member never comes in contact with the end of the shaft since there is an ample opening 174 therein.

After the connection is completely made, a safety plug 176 is placed within the block slot so as to bear upon the base of the U-shaped member. Cap screws 177 are used to hold safety plug 176 in place, as with the previous embodiments.

Now turning to FIG. 31, a straight shaft 180 is positioned within a block slot which is tapered so that its narrowest diameter is at the point where it is contiguous with the roller or main slot.

Figure 32:
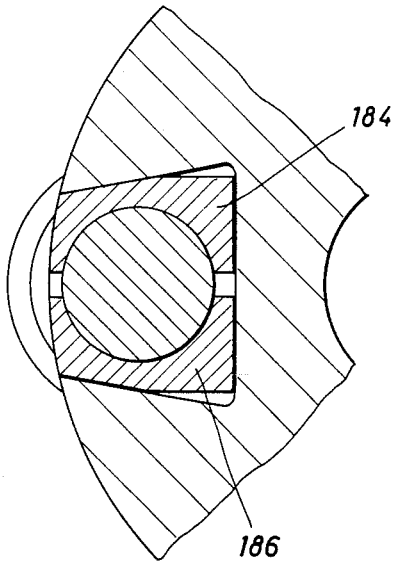

Block 182 includes external surfaces which are contiguous with the internal tapered surfaces of slot 181 just described. Block 182 also includes a longitudinal slot on two sides so that the block generally divides into two sections 184 and 186 for encompassing the shaft end. As the block is driven onto the shaft end the flexure provided by the two openings or slots in the block provide squeezing of the shaft end by the block. FIG. 32 provides a view of how this squeezing occurs.

Figure 33:
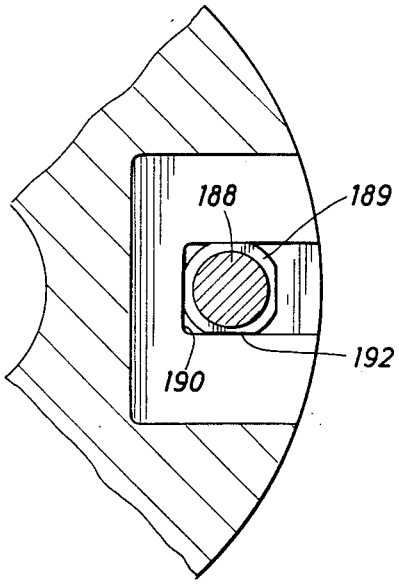
Figure 34:
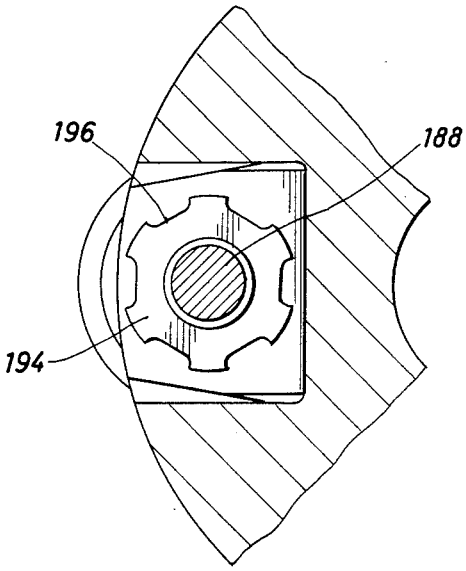
Figure 36:
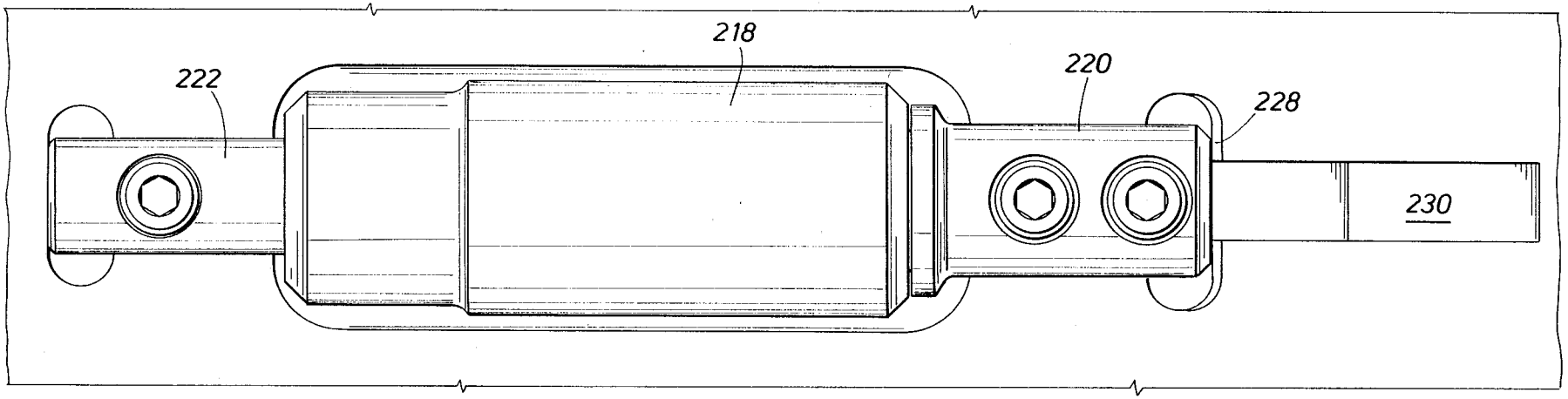
FIG. 36 is a partial top view looking down into a pocket of an alternate embodiment of a sealed-bearing reamer in accordance with the present invention and showing the roller-reamer unit.

The block is held tightly in place onto the shaft by a bolt and screw arrangement. Bolt 188 is axially elongate with the shaft end so that head 189 thereof, having flats thereon, is held in position on a shelf 190 and in an accommodating slot therefor with appropriate flats 192, as shown in FIG. 33. The screw shaft is threaded on its opposite end to accommodate a nut 194, which is screwed thereover. The nut is fluted on its outer surfaces at 196 to permit a tool for sideways driving to cause the nut to axially progress toward the end of the shaft to tighten and hold block 182 in place. It should be noted that an auxiliary tool may be used to hold head 189 of screw 188, rather than having it self-held; however, the self-held screw and bolt arrangement simplifies the tightening of the bolt with respect to the shaft of the screw.

Now referring to the embodiment of the invention shown in FIGS. 36–40, this embodiment is similar to the embodiment disclosed in FIG. 5 above. Therefore, with the exceptions of the differences hereafter described, it should be considered substantially indentical to such embodiment.

Roller-reamer 218 includes a pin end 220 which is wider than corresponding shaft end 222 at the opposite end of the unit to probide greater strength thereat. Each of these shaft ends are located within respectively accommodating slots in the manner for the other embodiments described above.

It is assumed that pin end 220 is toward the top of the roller-reamer apparatus when such apparatus is in use and that end 222 will be toward the bottom. In addition, pin end 220 includes two respectively aligned bored openings radial to the axis for receipt of cap screws 224 and 226, rather than a single bore and cap screw as with end 222.

In this embodiment, pin 220 is not made reversible, which permits the pin to be made stronger at the ends. Shoulder 228 abuts the end of pin 220 at this location.

Elongate removal slot 230 extends longitudinally above and from the slot accommodating shaft end 220 to permit removal with a drive out or removal tool 232 shown in dotted section. The tip end of shaft 220 is slightly tapered to permit the tool to be placed therebeneath. When the tool is used to pry up the pin end for removal purposes, the unit rotates about a point at the upper corner of the bottom shaft and additional clearance is made possible for continued rotation upward as soon as the abutting pin surface clears shoulder 228.

The lubrication and bearing systems which are illustrated are not described here in detail since they are substantially the same as for the embodiment shown and described for FIG. 5.

Figure 37:
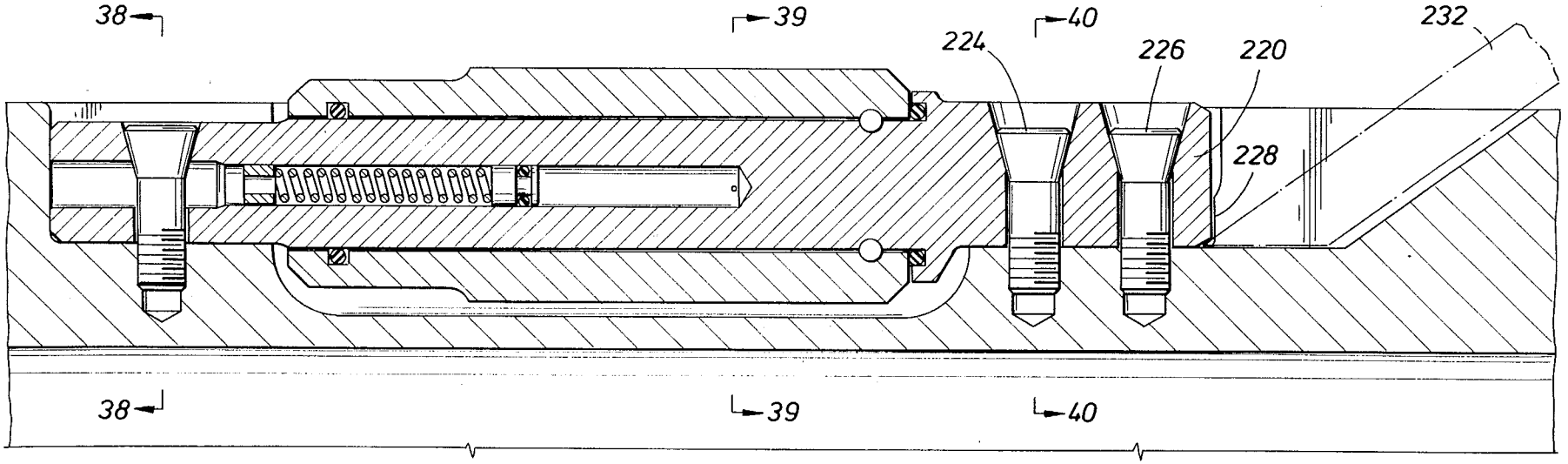
FIG. 37 is a longitudinal cross-sectional view of the roller-reamer unit employed in the reamer shown in FIG. 36.
Figure 38:
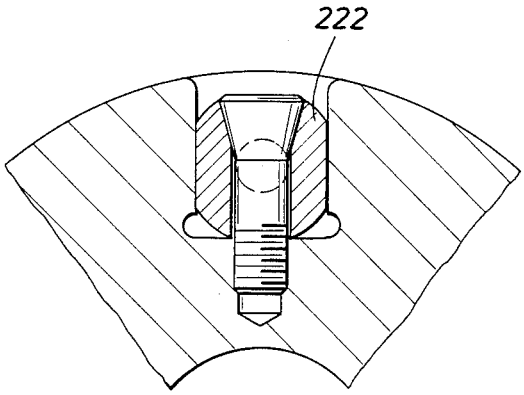
FIGS. 38, 39 and 40 are the respective cross-sectional views taken at lines 38—38, 39—39 and 40—40, respectively, shown in FIG. 37.
Figure 39:
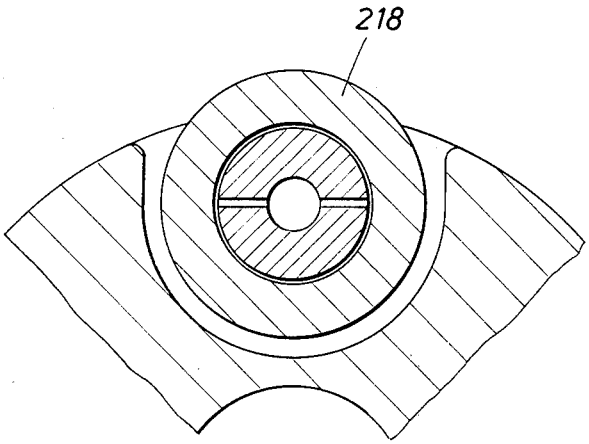
Figure 40:
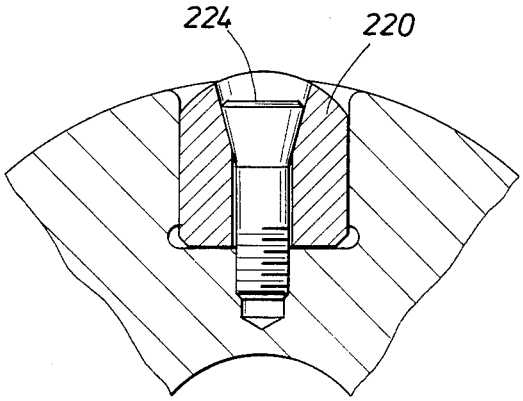

The reamer shown in FIG. 37, or for that matter, a reamer without a self-lubricating system, could also be constructed for carrying a thrust load in similar fashion to the FIG. 1 embodiment, if desired. That is, the top end of the reamer shaft, would include an enlargement or flange for carrying thrust loading with respect to a thrust bearing ring above the flange and with respect to the roller below the flange. The ring would have to be in separate sections if the shaft end is too large in any dimension to allow it to fit over the end to its position of use. The ring would then be secured at the upper end of the roller by welding, the ring being located between the roller and the shaft.

Although numerous embodiments have been shown and described, it will be understood that the invention is not limited thereto since many modifications may be made and will become apparent to those skilled in the art. The employment of tightly secured components, which are also releasable, results in the elimination of fretting which has heretofore caused rapid wearing of roller-reamer surfaces.

What is claimed is:

1. Roller-reamer bore hole drilling apparatus, comprising an elongate body having a fluid circulation hole therethrough surrounded by imperforate sidewalls and threaded at each end for connection within a drill string to adjoining members cooperatively threaded therewith, a plurality of outwardly opening elongate slotted pockets about said body, each of said pockets having a reduced contiguous slot in at least one end, a separate roller-reamer shaft accommodated by each of said pockets and having an end releasably rigidly inwardly secured to said body within said slot by a forced interference fit which elastically deforms the side walls of said slot and said shaft, a separate cylindrical roller rotatably secured about each of said shafts, the external surface of which radially projects beyond the limits of said body for contacting the internal wall of the bore hole, the respective pockets accommodating each of said rollers being sufficiently large to permit fluid circulating in the bore hole to surround said accommodated roller, radial bearing means located internal to each of said respective rollers, and thrust bearing means to limit axial movement of each of said rollers whereby said roller and shaft are removable and replaceable externally of said body.

2. Roller-reamer apparatus in accordance with claim 1, wherein respectively each of said shafts is rotationally 180 degrees reversible.

3. Roller-reamer apparatus in accordance with claim 1, wherein respectively said roller-reamer shaft and roller includes longitudinal limiting means for locating said roller within said accommodating pocket so that the bore hole is open to the shaft surface at the ends of said roller.

4. Roller-reamer apparatus in accordance with claim 1, wherein respectively the end of said shaft elastically deforms as it is pressed into contacting position with said reduced slot of said accommodating pocket in an interference fit.

5. Roller-reamer apparatus in accordance with claim 4, wherein said reduced slot includes a slight lateral enlargement to permit elastic deformation of said body.

6. Roller-reamer apparatus in accordance with claim 1, wherein respectively each of said reduced slots includes at least one flat side inward from the external surface of said body, and wherein respectively each of said shaft ends includes a flat side for contiguous interference fitting with said flat side of said reduced slot.

7. Roller-reamer apparatus in accordance with claim 1, wherein respectively for each separate roller-reamer shaft said shaft end is radially bored;

said body being radially bored and screw tapped within the confines of said reduced slot aligned with said shaft end radial bore; and including cap screw means for securing said shaft end to said body within said reduced slot by way of said radial bore in said shaft end and aligned bore in said reduced slot.

8. Roller-reamer apparatus in accordance with claim 1, wherein said thrust bearing means includes at each separate cylindrical roller a thrust bearing ring internally affixed to at least one end thereof and wherein said shaft includes a radial surface for acting in conjunction with said ring.

9. Roller-reamer apparatus in accordance with claim 1, and respectively for each separate roller-reamer shaft, lubricating means internal to said shaft for providing lubrication between said shaft and said roller, and seals substantially at both ends of said roller for confining said lubrication.

10. Roller-reamer apparatus in accordance with claim 9, and including at least one cutter affixed to said roller surface located below the lower of said seals.

11. Roller-reamer apparatus in accordance with claim 9, wherein said lubricating means includes a reservoir internal to said shaft, a port therefrom to the surface of said shaft between said seals, and a cooperatively acting pressure volume compensator acting on the lubrication within said reservoir.

12. Roller-reamer apparatus in accordance with claim 11, and including at least one cutter affixed to said roller surface located below the lower of said seals.

13. Roller-reamer apparatus in accordance with claim 11, wherein said compensator includes a piston and a cooperating compression spring.

14. Roller-reamer apparatus in accordance with claim 13, wherein said reservior is cylindrical and said piston includes an O-ring assembly interacting on the surface of said cylindrical reservoir and a plug for closing off the internal area of said O-ring assembly once said reservoir is preloaded with lubrication.

15. Roller-reamer apparatus in accordance with claim 9, wherein respectively said thrust bearing means are ball thrust bearings located between said shaft and said roller-reamer below the top of said seals.

16. Roller-reamer apparatus in accordance with claim 1, and including respectively for each roller-reamer shaft, an enlarged slot in said body contiguous with said reduced slot opposite said pocket, a safety plug accommodated by said enlarged slot for interacting with the end of said shaft for thrust load safety and bored for the receipt of at least one cap screw, said body being bored and tapped in alignment therewith within said enlarged slot, and a cap screw for releasably securing at each cap screw bore said safety plug to said body within said enlarged slot.

17. Roller-reamer apparatus in accordance with claim 16, and including respectively for each roller-reamer shaft, a shaft seat partly within said reduced slot and partly within said enlarged slot for laterally positioning said shaft.

18. Roller-reamer apparatus in accordance with claim 1, wherein each of said elongate slotted pockets includes a reduced contiguous slot in each of said top and bottom ends, said slot at one of said top and bottom ends and accommodated roller-reamer shaft being larger than said slot at the other of said top and bottom ends and other accommodated roller-reamer shaft.

19. Roller-reamer apparatus in accordance with claim 18, wherein the larger roller-reamer shaft includes two radial bores longitudinally spaced apart, said body being radially bored and screw tapped within the confines of said reduced slot aligned with said larger shaft end radial bores, and said releasable means includes cap screw means for securing said larger shaft end to said body within said reduced slot by way of said radial bores in said larger shaft end and aligned bores in said reduced slot.

20. Roller-reamer apparatus in accordance with claim 1 where at least one of said reduced slots contiguous with each of said pockets is further contiguous with a removal slot for receiving an externally inserted pry type removal tool.

21. Roller-reamer apparatus in accordance with claim 1 wherein the ends of said shaft have two flat parallel sides for continuous fit within two flat parallel sides of said slots within said body, and on the end of said shaft, a flat surface perpendicular to said parallel sides and engageable with a flat surface on said pockets within said body to limit radial inward movement of said shaft within said body.

22. Roller-reamer apparatus in accordance with claim 1 wherein means for inwardly securing said shaft within said body applies an impressive force between said shaft and said body in a direction perpendicular to the axis of said body.

23. Roller-reamer apparatus in accordance with claim 1 wherein the ends of said shaft have two flat parallel sides for continuous fit within two flat parallel sides of said slots within said body, and on the end of said shaft, a flat surface perpendicular to said parallel sides and engageable with a flat surface on said pockets within said body to limit radial inward movement of said shaft within said body, and means for inwardly securing said shaft within said body applies an impressive force between said shaft and said body in a direction perpendicular to the axis of the body.

24. Roller-reamer bore hole drilling comprising, an elongate body having a fluid circulation hold therethrough surrounded by imperforate sidewalls and threaded at each end for connection within a drill string to adjoining members cooperatively threaded therewith, a plurality of outwardly opening elongate slotted pockets about said body, each of said pockets having a reduced contiguous slot in at least one end, a separate roller-reamer shaft accommodated by each of said pockets and having an end releasably rigidly inwardly secured to said body within said slot by a forced interference fit which elastically deforms the side walls of said slot and said shaft, in each separate roller-reamer shaft said shaft end is radially bored;

said body being radially bored and screw tapped within the confines of said reduced slot aligned with said shaft end radial bore; and including cap screw means for securing said shaft end to said body within said reduced slot byway of said radial bore in said shaft end and aligned bore in said reduced slot, the internal opening of said shaft end radial bore is enlarged for accommodating an expandable puller for removing said shaft, a separate cylindrical roller rotatably secured about each of said shafts, the external surface of which radially projects beyond the limits of said body for contacting the internal wall of the bore hole, the respective pockets accommodating each of said rollers being sufficiently large to permit fluid circulating in the bore hole to surround said accommodated roller, radial bearing means located internal to each of said respective rollers, and thrust bearing means to limit axial movement of each of said rollers whereby said roller and shaft are removable and replaceable externally of said body.

25. Roller-reamer apparatus in accordance with claim 24 wherein said enlargement in said shaft end radial bore is suitable for receiving the head of said cap screw when said shaft is rotated 180 degrees.

26. Roller-reamer bore hole drilling apparatus, comprising an elongate body having a fluid circulation hole therethrough surrounded by imperforate sidewalls and threaded at each end for connection within a drill string to adjoining members cooperatively threaded therewith, a plurality of outwardly opening elongate slotted pockets about said body, each of said pockets having a reduced contiguous slot in at least one end, a separate roller-reamer shaft accommodated by each of said pockets and having an end releasably rigidly inwardly secured to said body within said slot by a forced interference fit which elastically deforms the side walls of said slot and said shaft, each said accommodated reduced slot for the end of said shaft is slightly enlarged at the tip of said shaft end to permit elastic deformation of said body for more uniform pressure between shaft and body, a separate cylindrical roller rotatably secured about each of said shafts, the external surface of which radially projects beyond the limits of said body for contacting the internal wall of the bore hole, the respective pockets accommodating each of said rollers being sufficiently large to permit fluid circulating in the bore hole to surround said accommodated roller, radial bearing means located internal to each of said respective rollers, and thrust bearing means to limit axial movement of each of said rollers whereby said roller and shaft are removable and replaceable externally of said body.

27. Roller-reamer bore hole drilling apparatus, comprising an elongate body having a fluid circulation hole therethrough surrounded by imperforate sidewalls and threaded at each end for connection within a drill string to adjoining members cooperatively threaded therewith, a plurality of outwardly opening elongate slotted pockets about said body, each of said pockets having a reduced contiguous slot in at least one end, a separate roller-reamer shaft accommodated by each of said pockets and having an end releasably rigidly inwardly secured to said body within said slot by a forced interference fit which elastically deforms the side walls of said slot and said shaft, a separate cylindrical roller rotatably secured about each of said shafts, the external surface of which radially projects beyond the limits of said body for contacting the internal wall of the bore hole, the respective pockets accommodating each of said rollers being sufficiently large to permit fluid circulating in the bore hole to surround said accommodated roller, each separate roller-reamer shaft having lubricating means internal to said shaft for providing lubrication between said shaft and said roller, and seals substantially at both ends of said roller for confining said lubrication, said shaft including a skirted groove for accommodating said top seal and said roller reamer including an upwardly abutting projection for cooperating with said top seal within said skirted groove, radial bearing means located internal to each of said respective rollers, and thrust bearing means to limit axial movement of each of said rollers whereby said roller and shaft are removable and replaceable externally of said body.

28. Roller-reamer bore hole drilling apparatus, comprising an elongate body having a fluid circulation hole therethrough surrounded by imperforate sidewalls and threaded at each end for connection within a drill string to adjoining members cooperatively threaded therewith, a plurality of outwardly opening elongate slotted pockets about said body, each of said pockets having a reduced contiguous slot in at least one end, a separate roller-reamer shaft accommodated by each of said pockets and having an end releasably rigidly inwardly secured to said body within said slot by a forced interference fit which elastically deforms the sidewalls of said slot and said shaft, an enlarged slot in said body contiguous with said reduced slot opposite said pocket for each roller-reamer shaft, a safety plug accommodated by said enlarged slot for interacting with the end of said shaft for thrust load safety and bored for the receipt of at least one cap screw, said body being bored and tapped in alignment therewith within said enlarged slot, and a cap screw for releasably securing at each cap screw bore said safety plug to said body within said enlarged slot, and the end of said shaft is longitudinally bored and said safety plug includes a longitudinal projection fitting within said longitudinal bore, a separate cylindrical roller rotatably secured about each of said shafts, the external surface of which radially projects beyond the limits of said body for contacting the internal wall of the bore hole, the respective pockets accommodating each of said rollers being sufficiently large to permit fluid circulating in the bore hole to surround said accommodated roller, radial bearing means located internal to each of said respective rollers, and thrust bearing means to limit axial movement of each of said rollers whereby said roller and shaft are removable and replaceable externally of said body.

29. Roller-reamer unit subcombination for securing into the body of a roller-reamer borehole drilling apparatus, comprising a roller-reamer shaft including having end means releasably rigidly inwardly secured to the body, a cylindrical roller rotatably securable about a portion of said shaft, top means and bottom means for sealing therebetween said portion of said shaft with respect to said roller, said top means for sealing including an annular sealing ring captive between an accommodating groove and an upward abutting projection on said shaft and said roller, radial bearing means located between said shaft and said roller, and thrust bearing means located within said sealed portion of said shaft with respect to said roller.

30. Roller-reamer unit subcombination in accordance with claim 29, and wherein said roller includes a reaming skirt portion below said bottom sealing means.

31. Roller-reamer unit subcombination in accordance with claim 29, and including lubricating means, having a reservoir internal to said shaft, a port therefrom to the surface of said shaft between said top and bottom sealing means, and a cooperatively acting pressure volume compensator acting on the lubrication within said reservoir.

32. Roller-reamer unit subcombination in accordance with claim 31 wherein said compensator includes a piston and a cooperating compression spring.

33. Roller-reamer unit subcombination in accordance with claim 32, wherein said reservoir is cylindrical and said piston includes an O-ring assembly interacting on the surface of said cylindrical reservoir and a plug for closing off the internal area of said O-ring assembly once said reservoir is preloaded with lubrication.

34. Roller-reamer unit subcombination for securing into the body of a roller-reamer borehole drilling apparatus, comprising a roller-reamer shaft including having end means releasably rigidly inwardly secured to the body, a cylindrical roller rotatably securable about a portion of said shaft, top means and bottom means for sealing therebetween said portion of said shaft with respect to said roller, said shaft includes a skirted groove for accommodating said top seal means, and said roller includes an upwardly abutting projection for cooperating with said top seal means within said skirted groove, radial bearing means located between said shaft and said roller, and thrust bearing means located within said sealed portion of said shaft with respect to said roller.

35. Roller-reamer unit subcombination for securing into the body of a roller-reamer borehole drilling apparatus, comprising a roller-reamer shaft including means for releasably connecting said shaft to the body, a cylindrical roller rotatably securably about a portion of said shaft, top means and bottom means for sealing therebetween said portion of said shaft with respect to said roller, radial bearing means located between said shaft and said roller, thrust bearing means located within said sealed portion of said shaft with respect to said roller, and lubricating means, having a reservoir internal to said shaft, a port therefrom to the surface of said shaft between said top and bottom sealing means, and a cooperatively acting pressure volume compensator acting on the lubrication within said reservoir, said compensator including a piston and cooperating compression spring.

36. Roller-reamer unit subcombination for securing into the body of a roller-reamer borehole drilling apparatus, comprising a roller-reamer shaft including means for releasably connecting said shaft to the body, a cylindrical roller rotatably securably about a portion of said shaft, top means and bottom means for sealing therebetween said portion of said shaft with respect to said roller, radial bearing means located between said shaft and said roller, thrust bearing means located within said sealed portion of said shaft with respect to said roller, and lubricating means, having a reservoir internal to said shaft, a port therefrom to the surface of said shaft between said top and bottom sealing means, a cooperatively acting pressure volume compensator acting on the lubrication within said reservoir, said compensator including a piston and cooperating compression spring, said shaft includes a skirted groove for accommodating said top seal means, and said roller includes an upwardly abutting projection for cooperating with said top seal means within said skirted groove.

37. Roller-reamer bore hole drilling apparatus, comprising an elongate body having a fluid circulation hole therethrough and threaded at each end for connection within a drill string to adjoining members cooperatively threaded therewith, a plurality of outwardly opening elongate slotted reamer pockets about said body, each of said reamer pockets having a contiguous block pocket in at least one end, a separate roller-reamer shaft accommodated by each of said reamer pockets and having an end for securing within said block pocket, a separate cylindrical roller rotatably securable about each of said shafts, the external surface of which radially projects beyond the limits of said body for contacting the internal wall of the borehole, the respective pockets accommodating each of said rollers being sufficiently large to permit fluid circulating in the borehole to surround said roller, radial bearing means located internal to each of said respective rollers, and respectively for each separate roller-reamer shaft, lubricating means for providing lubrication between said shaft and said roller, and top and bottom seals substantially at both ends of said roller for confining said lubrication, said shaft includes a skirted groove for accomodating said top seal, said roller includes an upwardly abutting projection for cooperating with said top seal within said skirted groove, thrust bearing means to limit axial movement of each of said rollers, and a block conforming to the shape of said block pocket secured therein to said body and tightly releasably securing the shaft end.

38. Roller-reamer borehole drilling apparatus, comprising an elongate body having a fluid circulation hole therethrough and threaded at each end for connection within a drill string to adjoining members cooperatively threaded therewith, a plurality of outwardly opening elongate slotted reamer pockets about said body, each of said reamer pockets having a contiguous block pocket in at least one end, a separate roller-reamer shaft accommodated by each of said reamer pockets and having an end for securing within said block pocket, a separate cylindrical roller rotatably securable about each of said shafts, the enternal surface of which raidally projects beyond the limits of said body for contacting the internal wall of the borehole, the respective pockets accommodating each of said rollers being sufficiently large to permit fluid circulating in the borehold to surround said roller, radial bearing means located internal to each of said respective rollers, thrust bearing means to limit axial movement of each of said rollers, a block conforming to the shape of said block pocket secured therein to said body and tightly releasably securing the shaft end, each reamer pocket therein including a contiguous enlarged opening for receiving a safety plug on the side of said block pocket includes at least one internal longitudinal tang along at least one wall thereof, each of said shafts is tapered toward its tip, and each of said blocks has a tapered internal opening for wedgedly fitting over a tapered end of a shaft and a mating continuous external slot for engaging said tang, said block securing said shaft tightly when driven onto said shaft end.

39. Roller-reamer apparatus in accordance with claim 38, wherein said block is externally notched to permit impact tool placement for driving said block onto said shaft end.

40. Roller-reamer apparatus in accordance with claim 39, wherein said block opening for receiving the tapered end of a shaft is open on the side, thereby providing flexure of said block about said opening with respect to said shaft end.

41. Roller-reamer apparatus in accordance with claim 38, wherein said plug is side slotted for receiving the tip of the end of said shaft after said block is in place.

42. Roller-reamer apparatus in accordance with claim 41 wherein said plug is bored for the receipt of at least one cap screw, said body being bored and tapped in alignment therewith within said safety plug opening, and a cap screw for releasably securing at each cap screw bore said plug to said body within said safety plug opening.

43. Roller-reamer unit subcombination for securing into the body of a roller-reamer borehole drilling apparatus, comprising a roller-reamer shaft including means for releasably connecting said shaft to the body, a cylindrical roller rotatably securably about a portion of said shaft, top means and bottom means for sealing therebetween said portion of said shaft with respect to said roller, radial bearing means located between said shaft and said roller, thrust bearing means located within said sealed portion of said shaft with respect to said roller, and lubricating means, having a reservoir internal to said shaft, a port therefrom to the surface of said shaft between said top and bottom sealing means, a cooperatively acting pressure volume compensator acting on the lubrication within said reservoir, said compensator including a piston and cooperating compression spring, said shaft includes a skirted groove for accommodating said top seal means, said roller includes an upwardly abutting projection for cooperating with said top seal means within said skirted groove, and respectively for each separate roller-reamer shaft, said shaft end is tapered toward its tip, said block includes a mating tapered hold therethrough for fitting over the end of said shaft and having outwardly turned lips deeply internal within said block pocket, said block pocket having inwardly turned lips near the external surface of said block being matingly tapered with said block pocket, wedge forcing of said block in said block pocket longitudinally toward said reamer pocket over the end by the flexible gripping of said mating hole, and including securing means located below said block with said block pocket to ensure against longitudinal displacement of said block.

44. Roller-reamer apparatus in accordance with claim 43, and wherein said wedge means is U-shaped and includes wedge tapered prongs along two sides of said block.

45. Roller-reamer apparatus in accordance with claim 43, and wherein said securing means includes a safety plug and at least one cap screw for affixing said safety plug to said body.

46. Roller-reamer borehole drilling apparatus, comprising an elongate body having a fluid circulation hole therethrough and threaded at each end for connection within a drill string to adjoining members cooperatively threaded therewith, a plurality of outwardly opening elongate slotted reamer pockets about said body, each of said reamer pockets having a contiguous block pocket in at least one end, a separate roller-reamer shaft accommodated by each of said reamer pockets and having an end for securing within said block pocket, a separate cylindrical roller rotatably securable about each of said shafts, the external surface of which radially projects beyond the limits of said body for contacting the internal wall of the borehole, the respective pockets accommodating each of said rollers being sufficiently large to permit fluid circulating in the borehole to surround said roller, radial bearing means located internal to each of said respective rollers, thrust bearing means to limit axial movement of each of said rollers, a block conforming to the shape of said block pocket secured therein to said body and tightly releasably securing the shaft end, and respectively for each separate roller-reamer shaft, said shaft end is not tapered, said block pocket is expandingly tapered longitudinally away from said reamer pocket, said block includes a mating hole at least partially therethrough for fitting over the end of said shaft, said mating hole being open slotted to the external surface of said block so that the surface of said mating hole flexibly surrounds said shaft end, the external surface of said block being matingly tapered with said block pocket, wedge forcing of said block in said block pocket longitudinally toward said reamer pocket over the end by the flexible gripping of said mating hole, and including securing means located below said block with said block pocket to ensure against longitudinal displacement of said block.

47. Roller-reamer apparatus in accordance with claim 46, wherein said block pocket and block are also tapered away from the side opening of said block pocket transverse to the axis of said shaft.

48. Roller-reamer apparatus in accordance with claim 46, and wherein said securing means includes a screw shaft axially elongate parallel with the axis of said shaft and a bolt acting thereon for outwardly tightening against said block to maintain a tight fit thereof on the end of said shaft.

49. Roller-reamer apparatus in accordance with claim 48, wherein said bolt is fluted for accommodating a side engaging tool for tightening said bolt on said screw shaft against said block.

50. Roller-reamer apparatus in accordance with claim 48, wherein said screw shaft includes a head connected thereto having at least one flat, and said block pocket includes an adjacent flat with respect thereto for preventing said screw shaft from rotating while said bolt is being tightened.

* * * * *